United States Patent [19]

Marzoli

[11] 3,936,997

[45] Feb. 10, 1976

[54] DEVICE FOR TAKING UP THE THREAD IN TEXTILE MACHINES

[75] Inventor: Angelo Marzoli, Bergamo, Italy

[73] Assignee: F.LLI Marzoli & C. S.p.A., Palazzolo Sull'Oglio (Brescia), Italy

[22] Filed: Aug. 8, 1974

[21] Appl. No.: 495,840

[30] Foreign Application Priority Data

Aug. 10, 1973 Italy ..... 27778/73

[52] U.S. Cl. ..... 57/34.5; 57/34 R

[51] Int. Cl.[2] ..... D01H 15/00

[58] Field of Search ..... 57/34.5, 34 R, 56, 156, 57/106

[56] References Cited

UNITED STATES PATENTS

| | | | |
|---|---|---|---|
| 2,819,579 | 1/1958 | Avera | 57/34.5 |
| 3,328,946 | 7/1967 | Schumann et al. | 57/34 R X |
| 3,482,387 | 12/1969 | Slack | 57/106 |
| 3,511,041 | 5/1970 | Korikovsky et al. | 57/34 R |
| 3,868,813 | 3/1975 | Vignon | 57/34.5 X |

FOREIGN PATENTS OR APPLICATIONS

| | | | |
|---|---|---|---|
| 1,172,368 | 11/1969 | United Kingdom | 57/34.5 |

*Primary Examiner*—John Petrakes

*Attorney, Agent, or Firm*—Waters, Schwartz & Nissen

[57] ABSTRACT

The invention relates to a device for taking up the thread in textile machines in which the tow or yarn travels from the drawing system to the wind-up unit through a closed conduit, either at the start of the spinning or after a breakage of the thread, comprising a bell shaped member, connected at its base to an aspiration unit through a flexible tube, and an electrically conductive spring lodged in the bell member so as to protrude beyond the mouth thereof, the spring being electrically connected to the aspiration unit, so that the aspiration action is started upon the spring contacting metallic parts, like the outlet of the thread to be fed to the drawing system.

3 Claims, 3 Drawing Figures

DEVICE FOR TAKING UP THE THREAD IN TEXTILE MACHINES

The present invention concerns a device for taking up the thread in textile machines, such as preparation machines for spinning and spinning machines themselves, of the type in which the travel of the tow or of the yarn between the drawing system and the wind-up unit is by means of pipes.

Devices of this type are known, and they act by leading the end of a thread, after a breakage of the thread during processing, through the pipes in order to have the said end of the thread knotted to the extremity of the thread leaving the drawing system. Up to the present time this operation was carried out by means of a flexible member which was introduced from the side of the drawing system into the closed pipe so as to bring the said flexible member to the opposite side of said closed pipe and so as to knot it to the thread leading to the wind-up device. Subsequently, the thread was drawn by means of the flexible member through the closed pipe in order to knot it at the end of the thread coming out of the drawing system.

This manner of proceeding calls for a correct guidance of the flexible member in the closed pipe and entails much loss of time with corresponding interruption of the processing: whence the performance of the machine is diminished. With the devices of the known type, moreover, it is possible to free the said pipe of dusts and of the fibres detaching themselves during the breakage of the thread.

The purpose of the present invention is to decrease to a remarkable extent the down-times of a spinning machine resulting from breakage of a thread and to effect, during the take-up of the broken thread for the purposes of its re-attachment, a cleaning of the closed pipe holding the thread.

According to the present invention, this purpose is achieved by means of the realization of a device for taking-up the thread after any breakage thereof in textile machines of the type in which the travel of the tow or yarn between the drawing system and the wind-up assembly is by means of a closed pipe, the said device consisting of a bell of electrically insulant material, communicating through its base with a flexible tube connected to an aspiration unit, an electrically conductive spring being housed in the said bell in such a way that it protrudes beyond the free edge of this latter, and an electrical control of the said aspiration unit being electrically connected with the said spring in such a way as to actuate the action of aspiration of the said unit when the spring is brought into contact with metallic parts.

The flexible tube can with advantage be connected up to the general aspiration system of the drawing system.

The bell can of course be lined with electrically insulant material, or else be realized entirely in insulant material.

The device according to the invention will be better understood by means of the following description of one embodiment thereof as represented in the attached drawings, in which.

Figures 1, 2, 3:
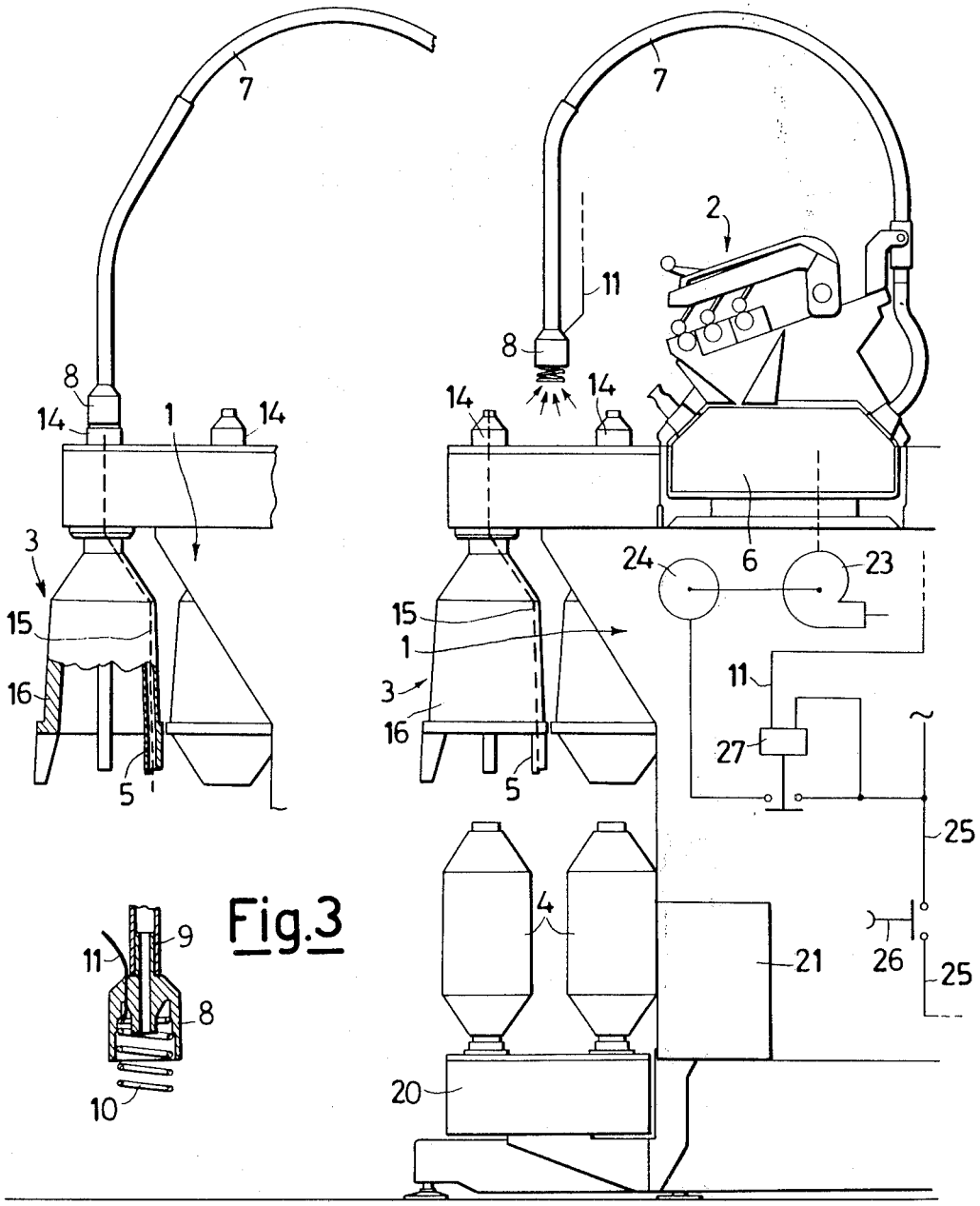
FIG. 1 represents a spinning machine with the device according to the invention, in non-operative position.
FIG. 2 represents the same device in an operative position.
FIG. 3 is an axial section of the device according to the invention.

There is shown in the Figures, for a possible use of the device according to the invention, a speed frame for the spinning of the tow.

As is known, a frame of such type consists of a frame 1, onto which are mounted the drawing system, indicated generically with 2, the tow guide units, indicated generically with 3 and by the wind-up spindles 4. These last are rotatorily borne by a carriage 20, supported by a device 21 which actuates its movement for the correct winding of the bobbins.

Below the drawing system 2 there is installed a passage 6, placed into depression by aspirators shown schematically at 23, such passage being such as to remove the spinning wastes and the impurities deriving from the tow during the drawing step. The aspirators 23 are actuated by motors 24.

The guide units 3 are substantially constituted by a mouth 14 of a conveyance conduit 5 which extends into a tow-guide 16 having the form of a bell.

No further explanation is given of other particularities and details of machine, since they are not necessary for the understanding of the invention, and are well-known to persons skilled in the art.

Communicating with the passage 6 is a flexible tube 7 which extends above the drawing system 2 and comes close to the mouth 14. At the free end of the tube 7 there is applied a bell 8, preferably in electrically insulant material. At its base, the bell 8 has a tubular portion 9 which extends axially, partly inside itself and partly outside itself. In the bell 8 there is housed a spring 10, in electrically conductive material, in such a way that the tube 9 is surrounded by it. The spring 10 protrudes, furthermore, beyond the opening of the bell 8 and is electrically connected at 11, with a circuit shown in FIG. 1, which controls the feed of the motors 24 when the spring 10 contacts metallic parts, in particular when the bell 8 is aligned in contact with the mouth 14.

It should be noted, finally, that the internal diameter of the tube 9 is less than that of the flexible tube 7, in order to increase therein the velocity of the air.

The functioning of the device according to the invention is as follows:

The tow 15 leaves the drawing system and is guided through the conduit 5, to be wound onto the spindle 4.

At the start of a spinning run, or in the event of breakage of the tow or of a thread in general, the machine and the aspiration are stopped as the result of manual intervention or automatic systems, for example systems controlled by a photoelectic cell, well-known in the field; the end of the tow on the side of the spindles 4 must be introduced again into the conduit in order to be brought into the vicinity of the drawing system 2, and, more exactly, up to the extremity of the tow on the side of the drawing system.

To an electric line 25 there are connected, by means of a switch 26, the actuating organs of the machine that are not shown in the drawings. To the line 25 there is separately connected, by means of a remote-control switch 27, each of the motors 24. The remote-control switch receives a contact signal from the line 11 when the spring 10 touches the mouth 14.

With the machine stopped, as a result of the bell 8 fitting over the mouth 14, an aspiration is then effected through this latter, which pulls the tow 15 through the conduit 5; when the bell is lifted, and the motor 24 then stopped, the tow is taken up by hand and then knotted to the end of the tow leaving the stretching system.

The machine is then started by throwing the general switch 26. When this switch has been thrown, the motors 24 can also be fed when the system of aspiration through the passage 6 is also intended to effect the cleaning of the wastes and dusts, etc.

The device according to the invention can be predisposed for a plurality of spindles.

What is claimed is:

1. A thread taking-up device for textile machines comprising a drawing system, a wind-up unit and a conduit for transferring the thread from the drawing system to the wind-up unit, said device comprising a bell of electrically insulated material, a flexible tube connecting the bell to an aspiration unit, an electrically conductive spring housed within said bell and protruding outwardly therefrom and an electrical control for the aspiration unit, said control being electrically connected to said spring for starting operation of the aspiration unit when the spring is brought into contact with metallic means.

2. A thread taking-up device according to claim 1, wherein said bell has a tubular extension for connection thereof to said flexible tube, said tubular extension having an internal cross-section smaller than the internal cross-section of said flexible tube.

3. A thread taking-up device according to claim 1, including a textile machine having an auxiliary aspiration and cleaning unit, said first-mentioned aspiration unit of said thread taking-up device being formed by said auxiliary unit of the textile machine.

* * * * *